US009724910B2

(12) United States Patent
Nagoshi

(10) Patent No.: US 9,724,910 B2
(45) Date of Patent: Aug. 8, 2017

(54) PRINTING PAPER FOR INDUSTRIAL ROTARY INKJET PRINTING PRESS AND METHOD FOR PRODUCING PRINTED MATERIAL

(71) Applicant: MITSUBISHI PAPER MILLS LIMITED, Tokyo (JP)

(72) Inventor: Masanori Nagoshi, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 15/046,800

(22) Filed: Feb. 18, 2016

(65) Prior Publication Data

US 2016/0271985 A1 Sep. 22, 2016

(30) Foreign Application Priority Data

Mar. 20, 2015 (JP) ..... 2015-057842
Nov. 18, 2015 (JP) ..... 2015-225871

(51) Int. Cl.
*B41F 11/00* (2006.01)
*B41M 5/52* (2006.01)
*B41M 5/50* (2006.01)

(52) U.S. Cl.
CPC ..... *B41F 11/00* (2013.01); *B41M 5/50* (2013.01); *B41M 5/508* (2013.01); *B41M 5/5218* (2013.01); *B41M 5/5254* (2013.01)

(58) Field of Classification Search
CPC .... B41M 5/50; B41M 5/5218; B41M 5/5254; B42J 2/01
See application file for complete search history.

(56) References Cited

U.S. PATENT DOCUMENTS 5,958,579 A * 9/1999 Idei ..... B41M 5/5245 428/32.22
2003/0234846 A1* 12/2003 Koga ..... B41M 5/0035 347/100
2009/0130309 A1* 5/2009 Kawakami ..... B41M 5/502 427/261
2013/0176371 A1* 7/2013 Nagoshi ..... D21H 19/44 347/106
2014/0362581 A1* 12/2014 Kim ..... F21V 5/045 362/294

FOREIGN PATENT DOCUMENTS

| | | | |
|---|---|---|---|
| JP | 2003-291506 | A | 10/2003 |
| JP | 2005-320651 | A | 11/2005 |
| JP | 2008-297679 | A | 12/2008 |
| JP | 2009-125953 | A | 6/2009 |
| JP | 2011-161720 | A | 8/2011 |
| JP | 2012-111123 | A | 6/2012 |
| JP | 2015-013459 | A | 1/2015 |

* cited by examiner

*Primary Examiner* — Betelhem Shewareged
(74) *Attorney, Agent, or Firm* — Birch, Stewart, Kolasch & Birch, LLP

(57) ABSTRACT

Printing paper for an industrial rotary inkjet printing press is provided that has superior printability with respect to an offset printing press, and has superior color density uniformity, inhibition of ink strike-through and dot reproducibility with respect to an industrial rotary inkjet printing press using water-based pigment ink. The printing paper for an industrial rotary inkjet printing press comprises a base paper and at least one coating layer containing pigment, binder and water-soluble polyvalent cation salt on at least one side of the base paper, wherein at least one of the pigment is kaolin having an average particle diameter of 0.20 μm to 1.50 μm, and the content of the kaolin in the coating layer is 50 parts by weight or more based on 100 parts by weight of the pigment in the coating layer, the content of the water-soluble polyvalent cation salt in the coating layer is 1.0 parts by weight to 6.0 parts by weight based on 100 parts by weight of the pigment in the coating layer, and the surface resistivity on the coating layer side of the printing paper in an environment at 23° C. and 50% RH as determined basically in compliance with JIS K 6911:2006 is $2.0\times10^{10}$ Ω to $5.0\times10^{12}$ Ω.

2 Claims, No Drawings

PRINTING PAPER FOR INDUSTRIAL ROTARY INKJET PRINTING PRESS AND METHOD FOR PRODUCING PRINTED MATERIAL

CROSS-REFERENCE TO RELATED APPLICATIONS

The present application claims priorities to Japanese Patent Application Nos. 2015-057842, filed Mar. 20, 2015 and 2015-225871, filed Nov. 18, 2015. The contents of these applications are incorporated herein by reference in their entirety.

BACKGROUND OF THE INVENTION

Field of the Invention

The present invention relates to printing paper for an industrial inkjet printing press to be used in an industrial rotary inkjet printing press and to a method for producing a printed material that uses that printing paper for an industrial inkjet printing press.

Description of Related Art

A rotary type of industrial inkjet printing press that uses an inkjet recording system is known as an industrial or commercial printing press for producing large quantities of commercial printed material or newspapers (see, for example, Patent Document 1). Industrial rotary inkjet printing presses are sold under the names of, for example, the Truepress Jet manufactured by Dainippon Screen Mfg. Co., Ltd., the MJP Series manufactured by Miyakoshi Printing Machinery, Co., Ltd., Prosper and Versamark manufactured by the Eastman Kodak Co , Inkjet Web Press manufactured by the Hewlett-Packard Co., and JetLeader manufactured by Tokyo Kikai Seisakusho, Ltd.

Although dependent on various printing conditions, these industrial rotary inkjet printing presses have color printing speeds of 60 m/min or more that are more than ten times faster than ordinary, home-use inkjet printers, small-office/home-office (SOHO) inkjet printers and large-format inkjet printers. These printing presses demonstrate particularly high newspaper printing speeds, with industrial rotary inkjet printing presses for newspaper applications demonstrating printing speeds of greater than 100 m/min within the range of 150 m/min to 200 m/min. Consequently, industrial rotary inkjet printing presses are distinguished from ordinary, home-use inkjet printers, SOHO inkjet printers and large-format inkjet printers.

Industrial rotary inkjet printing presses are able to accommodate on-demand printing since they are capable of handling variable information. There are many cases in which printing companies employ a system in which fixed information is printed with a conventional printing press such as an offset rotary printing press, while variable information is printed with an industrial rotary inkjet printing press. Offset rotary printing presses are used particularly frequently for conventional printing presses from the viewpoints of printing quality and production cost.

Thus, it is necessary to have printability for both printing by a conventional printing press such as an offset rotary printing press and printing by an industrial rotary inkjet printing press. Unless printability for both of these types of printing is provided, printed material having adequate image quality as a commercial product cannot be produced by these printing presses.

Coated paper for inkjet printing is known for use as coated paper for inkjet printing that has high white paper glossiness, superior ink absorbency, ink fixability and coated layer strength and allows the obtaining of high-quality printed material using a commercial inkjet printing press, the coated paper for inkjet printing having a coated layer containing pigment and binder on at least one side of a base paper, wherein the pigment contains 70% by weight or more of acicular precipitated calcium carbonate, the binder contains a latex binder and starch, the ratio of the weight of the latex binder to the weight of the starch (weight of latex binder/weight of starch) is 0.3 to 25, and the ratio of the weight of the pigment to the weight of the binder in the coating layer (ratio of weight of pigment/weight of binder) is 3 to 30 (see, for example, Patent Document 2).

Newsprint paper for inkjet-compatible offset printing is known for use as newsprint paper for inkjet-compatible offset printing that has printability with a newspaper offset rotary press while also having superior inkjet printability, the newsprint paper for inkjet-compatible offset printing containing primarily waste paper pulp for the pulp raw material of the base paper, containing white carbon for the filler, is made without an internal sizing agent, and is subjected to sizing with a surface sizing agent, wherein (a) the fiber composition of defibrated pulp is such that the amount of needle bleached kraft pulp is 15% by weight or less, (b) the length-average fiber length of the defibrated pulp is 0.7 mm to 1.0 mm, (c) the length-average fiber length distribution of the defibrated pulp is such that pulp having a length-average fiber length of 1.2 mm or more accounts for 20% or less of the defibrated pulp, (d) the newsprint paper is coated with a surface treatment agent containing a surface sizing agent and a binder and the water absorption time thereof is 50 seconds to 170 seconds, and (e) the shape factor resulting from inkjet printing as determined using a specific measurement method is 100 to 200 (see, for example, Patent Document 3).

PATENT DOCUMENTS

Patent Document 1: Japanese Unexamined Patent Publication No. 2012-111123

Patent Document 2: Japanese Unexamined Patent Publication No. 2015-013459

Patent Document 3: Japanese Unexamined Patent Publication No. 2011-161720

BRIEF SUMMARY OF THE INVENTION

Although ink used in industrial rotary inkjet printing presses roughly consists of water-based dye ink and water-based pigment ink, there are many cases in which water-based pigment ink is used from the viewpoints of storageability, such as weather resistance, and color density.

In the case of water-based pigment ink, color density of printed areas may become non-uniform if partial variations occur in ink absorbency of the printing paper as printing speed increases. This is due to the concentration at which the coloring material is contained in ink used in industrial inkjet printing presses being lower in comparison with conventional printing presses such as offset printing presses based on the principle of inkjet printing in which ink droplets are jetted from fine nozzles. In addition, in the case of water-based pigment ink, dot reproducibility in printed areas may decrease if ink absorbency of the printing paper becomes inadequate as printing speed increases. A decrease in dot reproducibility results in poor image quality. This is due to the paper transport speed increasing in proportion to an increase in printing speed, resulting in ink droplets adhered to the surface of the printing paper running after having impacted the paper surface. Namely, dots formed with ink droplets that have impacted the paper surface have an irregular shape or the contour of the dots becomes indistinct, thereby causing a decrease in image quality.

Color is being used increasingly frequently in not only the field of commercial printing, but also in the field of newspaper printing, and there is a growing demand for higher levels of image quality. Newsprint paper is susceptible to the occurrence of ink strike-through phenomenon due to the low basis weight of the paper. This is due to the ink used in industrial inkjet printing presses having a lower coloring material content concentration in comparison with the ink of offset printing presses and other conventional printing presses. Paper such as newsprint paper having a low basis weight is susceptible to the occurrence of ink strike-through phenomenon when ink absorbency is increased. "Ink strike-through" refers to a phenomenon in which ink penetrates deep into the paper without stopping at the surface on the printed side resulting in the printed image being visible from the opposite side. Since duplex printing is frequently used in commercial printing, strike-through phenomenon impairs product value.

The coated paper for inkjet printing described in Patent Document 2 and the newsprint paper for inkjet-compatible offset printing described in Patent Document 3 require further improvement with respect to color density uniformity of printed areas, dot reproducibility and inhibition of ink strike-through.

An object of the present invention is to provide printing paper for an industrial rotary inkjet printing press that has the performance indicated below.

1. Has printability with respect to offset printing presses (offset printability).

2. Has superior color density uniformity of printed areas with respect to industrial rotary inkjet printing presses using water-based pigment ink (color density uniformity).

3. Has superior inhibition of ink strike-through with respect to industrial rotary inkjet printing presses using water-based pigment ink (strike-through inhibition).

4. Has superior dot reproducibility with respect to industrial rotary inkjet printing presses using water-based pigment ink (dot reproducibility).

In addition, an object of the present invention is to provide a method for producing a printed material production method that uses an industrial rotary inkjet printing press capable of producing printed material that demonstrates superior color uniformity in printed areas, superior inhibition of strike-through and superior dot reproducibility.

As a result of conducting extensive studies with the foregoing in view, the inventor of the present invention achieved the object of the present invention in the manner described below.

(1) Printing paper for an industrial rotary inkjet printing press, comprising a base paper and at least one coating layer containing pigment, binder and water-soluble polyvalent cation salt on at least one side of the base paper, wherein at least one of the pigment is kaolin having an average particle diameter of 0.20 μm to 1.50 μm, and the content of the kaolin in the coating layer is 50 parts by weight or more based on 100 parts by weight of the pigment in the coating layer, the content of the water-soluble polyvalent cation salt in the coating layer is 1.0 parts by weight to 6.0 parts by weight based on 100 parts by weight of the pigment in the coating layer, and the surface resistivity on the coating layer side of the printing paper in an environment at 23° C. and 50% RH as determined basically in compliance with JIS K 6911:2006 is $2.0\times10^{10}$ Ω to $5.0\times10^{12}$ Ω.

(2) A method for producing a printed material, comprising the steps of:

obtaining the printed paper for an industrial rotary inkjet printing press described in (1) above, and obtaining a printed material by printing on the printing paper with an industrial rotary inkjet printing press using water-based pigment ink.

According to the present invention, printing paper for an industrial rotary inkjet printing press can be provided that has superior printability with respect to an offset printing press, as well as superior color density uniformity, superior strike-through inhibition and superior dot reproducibility with respect to an industrial rotary inkjet printing press using water-based pigment ink. In addition, according to the present invention, a method for producing a printed material that uses an industrial rotary inkjet printing press can be provided that enables the production of printed materials having superior color density uniformity in printed areas, superior inhibition of strike-through and superior dot reproducibility.

The effects of the present invention can be obtained due to synergistic effects attributable to a coating layer containing pigment in the form of a specific kaolin, binder and water-soluble polyvalent cation salt, and setting the surface resistivity on the coating layer side of the printing paper to a specific range.

DETAILED DESCRIPTION OF THE INVENTION

The following provides a detailed explanation of the printing paper for an industrial rotary inkjet printing press of the present invention (to be simply referred to as "printing paper"). When used in the present description, "inkjet printing" refers to printing using an industrial rotary inkjet printing press. Industrial rotary inkjet printing presses are described, for example, in the Patent Document 1 (Japanese Unexamined Patent Publication No. 2012-111123) and are sold under the names of, for example, the Truepress Jet manufactured by Dainippon Screen Mfg. Co., Ltd., the MJP Series manufactured by Miyakoshi Printing Machinery, Co., Ltd., Prosper and Versamark manufactured by the Eastman Kodak Co., Inkjet Web Press manufactured by the Hewlett-Packard Co., and JetLeader manufactured by Tokyo Kikai Seisakusho, Ltd.

In the case of printing fixed information in the national news section of a newspaper and printing variable information such as local articles or advertisements in the local news section, for example, all or a portion of the fixed information is preferably printed using a conventional printing press such as a gravure printing press, offset printing press, letterpress printing press or flexographic printing press. An offset rotary printing press is particularly preferable from the viewpoints of printing quality and production cost. Printing using a conventional printing press may be carried out before or after printing using an industrial rotary inkjet printing press.

A gravure printing press is a printing press of the type in which ink is transferred to a printed object via a roller-shaped plate cylinder having an image engraved therein. An offset printing press is a printing press of the indirect printing type in which ink is transferred to a blanket and then re-transferred to a printed object. A letterpress printing press is a printing press of the relief printing type in which ink imparted to a relief printing plate is printed on a printed object by applying pressure so as to press against the printed object. A flexographic printing press is a printing press of the relief printing type that uses a flexible, elastic plastic plate.

The base paper is paper that is made using a conventionally known method such as acidic papermaking, neutral papermaking or alkaline papermaking from paper stock containing at least one type of chemical pulp such as leaf bleached kraft pulp (LBKP) or needle bleached kraft pulp (NBKP), mechanical pulp such as groundwood pulp (GP), pressure groundwood pulp (PGW), refiner mechanical pulp (RMP), thermomechanical pulp (TMP), chemithermomechanical pulp (CTMP), chemimechanical pulp (CMP) or chemigroundwood pulp (CGP), or waste paper pulp such as deinked pulp (DIP), a filler, and various types of additives such as a sizing agent, fixing agent, retention agent or cationizing agent as necessary.

In the present invention, a conventionally known pigment can be used as filler. Examples of pigments include inorganic pigments such as precipitated calcium carbonate, ground calcium carbonate, kaolin, talc, calcium sulfate, barium sulfate , titanium dioxide, zinc oxide, zinc sulfide, zinc carbonate, satin white, aluminum silicate, diatomaceous earth, alumina, lithopone, zeolite, magnesium carbonate or magnesium hydroxide. Moreover, examples of organic pigments include styrene-based plastic pigments, acrylic-based plastic pigments, polyethylene, microcapsules, urea resin and melamine resin. In addition, a plurality of types thereof can be used in combination.

The base paper can also suitably contain other additives within a range that does not impair the desired effects of the present invention, and examples thereof include a pigment dispersant, thickener, fluidity improver, defoamer, antifoamer, releasing agent, foaming agent, penetrant, coloring dye, coloring pigment, optical brightener, ultraviolet absorber, antioxidant, preservative, fungicide, insolubilizer and paper strengthening agent.

The printing paper of the present invention has at least one coating layer containing a pigment, binder and water-soluble polyvalent cation salt on at least one side of the base paper.

At least one of the pigments is kaolin having an average particle diameter of 0.20 μm to 1.50 μm. The average particle diameter of kaolin is preferably 0.40 μm to 1.30 μm, and more preferably 0.50 μm to 1.20 μm. The content of the kaolin in the coating layer is 50 parts by weight or more, preferably 55 parts by weight to 90 parts by weight, and more preferably 60 parts by weight to 80 parts by weight, based on 100 parts by weight of pigment in the coating layer. In the case the pigment in the coating layer deviates from the aforementioned conditions, the printing paper is unable to obtain offset printability or is unable to obtain color density uniformity or dot reproducibility with respect to an industrial rotary inkjet printing press that uses a water-based pigment ink In particular, the printing paper has superior dot reproducibility by containing the kaolin having the aforementioned average particle diameter in the aforementioned range. Although the reason for this is unclear, it is presumed to be as described below. The normal form of kaolin is tabular particle, and it is said that the plain part of the kaolin particle is charged negative, while the edge part of the kaolin particle is charged positive. Therefore, kaolin is easy to obtain affinity for color materials having negative charge and for dispersants having positive charge of the color materials. Consequently, ink droplets that have impacted the paper surface are hard to run, thereby making the printing paper having superior dot reproducibility.

Kaolin is produced by industrially refining and processing naturally produced kaolinite followed by going through steps such as crushing, washing, deferrization or classification. In addition, this includes highly processed kaolin such as delaminated kaolin, which has been formed into thin plates by applying shearing force in order to improve aspect ratio, engineered kaolin, which has been adjusted to have a sharp particle size distribution, or calcined kaolin, which has enhanced cohesion.

In the present invention, average particle diameter is the average particle diameter of single particles in the case of single particles, or the average particle diameter of aggregated particles in the case of forming secondary particles or other aggregated particles. The average particle diameter of kaolin can be determined while in the state of printing paper. The method for determining average particle diameter consists of capturing an electron micrograph of the coating layer surface of the printing paper using a scanning electron microscope equipped with an energy-dispersive X-ray spectrometer or other elemental analysis function, calculating particle diameter by assuming that the image area of the photographed particles approximates that of a sphere, and calculating the average particle diameter by measuring 100 particles present in the photographed image.

Average particle diameter can also be determined by measuring using laser diffraction/scattering or dynamic light scattering. In this case, average particle diameter refers to average particle diameter based on measurement of volume-based particle size distribution using laser diffraction/scattering or dynamic light scattering.

Average particle diameter can be calculated from the resulting particle size distribution. For example, average particle diameter can be calculated by measuring particle size distribution using the Microtrac MT300EXII laser diffraction/scattering type particle size distribution analyzer manufactured by Nikkiso Co., Ltd.

The coating layer can contain a pigment other than the aforementioned kaolin that is conventionally known in the field of papermaking. Examples of conventionally known pigments include inorganic pigments such as clay, ground calcium carbonate, precipitated calcium carbonate, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, aluminum hydroxide, alumina, lithopone, zeolite, magnesium carbonate or magnesium hydroxide. Moreover, examples of organic pigments include styrene-based plastic pigments, acrylic-based plastic pigments, styrene-acrylic-based plastic pigments, polyethylene, microcapsules, urea resin and melamine resin.

The binder is a binder that is conventionally known in the field of papermaking, and examples thereof include acrylic acid-based polymers such as sodium polyacrylate or polyacrylamide, polyvinyl acetate-based copolymers, various types of copolymers such as styrene-butadiene copolymers or ethylene-vinyl acetate copolymers, polyvinyl alcohol, modified polyvinyl alcohol, polyethylene oxide, formalin resins such as urea resin or melamine resin and water-soluble synthetic products such as polyethyleneimine, polyamide polyamine or epichlorhydrin. Additional examples of binders include starch purified from natural plants, hydroxyethylated starch, oxidized starch, etherified starch, starch phosphate, enzyme-modified starch or cold water-soluble starch obtained by the flash drying thereof, and natural polysaccharides such as dextrin, mannan, chitosan, arabinogalactan, glycogen, inulin, pectin, hyaluronic acid, carboxymethyl cellulose or hydroxyethyl cellulose and their oligomers and modified forms thereof. Moreover, other examples of binders include natural proteins such as casein, gelatin, soybean protein or collagen and their modified forms, and synthetic polymers and oligomers such as polylactic acid or peptides. One type of binder selected therefrom can be used alone or two or more types can be used in combination. In addition, the binder can be used after subjecting to cationic modification.

The content of binder in the coating layer is preferably 3 parts by weight to 30 parts by weight, and more preferably 5 parts by weight to 20 parts by weight, based on 100 parts by weight of pigment in the coating layer. This is because, if the binder content is within the aforementioned ranges, ink absorbency of the printing paper becomes more favorable.

The water-soluble polyvalent cation salt is a water-soluble salt that contains a polyvalent metal cation. The polyvalent cation salt is preferably a salt containing a polyvalent metal cation and being able to dissolving to 1% by weight or more in water at 20° C. Examples of polyvalent metal cations include divalent cations such as magnesium, calcium, strontium, barium, nickel, zinc, copper, iron, cobalt, tin or manganese ions, trivalent cations such as aluminum, iron or chromium ions, tetravalent cations such as titanium or zirconium ions, and complex ions thereof. There are no particular limitations on the anion that forms a salt with the polyvalent metal cation, and may be an anion of an inorganic acid or organic acid. Examples of inorganic acids include hydrochloric acid, nitric acid, phosphoric acid, sulfuric acid, boric acid and hydrofluoric acid. Examples of organic acids include formic acid, acetic acid, lactic acid, citric acid, oxalic acid, succinic acid and organic sulfonic acids.

In the present invention, the water-soluble polyvalent cation salt is preferably a calcium salt such as calcium chloride, calcium formate, calcium nitrate or calcium acetate. The reason for this is that strike-through inhibition is obtained to a greater degree. Calcium chloride or calcium nitrate is preferable from the viewpoint of chemical cost.

The content of the water-soluble polyvalent cation salt in the coating layer is 1.0 part by weight to 6.0 parts by weight based on 100 parts by weight of pigment in the coating layer. The content is preferably 1.5 parts by weight to 5.0 parts by weight and more preferably 2.0 parts by weight to 4.5 parts by weight from the viewpoint of the balance between strike-through inhibition and dot reproducibility. If the content of the water-soluble polyvalent cation salt in the coating layer is outside the aforementioned ranges, at least one of color density uniformity, strike-through inhibition or dot reproducibility cannot be obtained for the printing paper. In particular, strike-thorough inhibition can be obtained by containing the water-soluble polyvalent cation salt (in particular, calcium salt) in the aforementioned content. Although the reason for this is unclear, it is presumed to be as described below. The cation of the water-soluble polyvalent cation salt is adsorbed onto the plain parts of kaolin charged negative, while the cation interacts with the color material having negative charge in the ink. Consequently, it is considered that the water-soluble polyvalent cation salt can interact with the color material in the area of the plain parts of the kaolin, thereby inhibiting the achievement of the color material into the depths of the paper. It is considered that, in particular, the calcium ion of the calcium salt is easy to be adsorbed onto the plate parts of kaolin.

In addition to the pigment, binder and water-soluble polyvalent cation salt, the coating layer can also contain, as necessary, various types of conventionally known assistants normally used in the field of papermaking, examples of which include pigment dispersants, thickeners, deformers, antiformers, foaming agents, releasing agents, penetrants, wetting agents, heat gelling agents, printability improvers, dye fixing agents, lubricants, dyes, optical brighteners or water resistant agents.

The coating layer can be obtained by coating a coating layer-coating color onto base paper and drying. Examples of methods used to coat the coating layer-coating color include, but are not limited to, methods using various types of blade coaters such as a rod blade coater as well as an air knife coater, roll coater, bar coater, curtain coater, short dwell coater or film transfer coater. Various types of blade coaters or film transfer coaters suitable for high-speed productivity are preferable, and a film transfer coater is particularly preferable.

Examples of drying methods include, but are not limited to, methods using various types of drying devices, examples of which include hot air dryers such as a straight tunnel dryer, arch dryer, air loop dryer or sine curve air flotation dryer, infrared heating dryers and dryers using microwaves.

The coated amount on the coating layer is preferably 3.0 $g/m^2$ to 10.0 $g/m^2$ per side, and more preferably 4.0 $g/m^2$ to 8.0 $g/m^2$ per side, from both the viewpoints of printability with respect to an offset rotary printing press or other conventional printing press and ink absorbency with respect to an industrial rotary inkjet printing press. Furthermore, in the present invention, coated amount refers to the coated amount of bone dry solids per side. In the case two or more coating layers are present on per side of the base paper, the coated amount refers to the total coated amount thereof.

In the present invention, the surface resistivity of the printing paper is the value of surface resistivity on the coating layer side of the printing paper having the coating layer of the present invention in an environment at 23° C. and 50% RH as determined basically in compliance with JIS K 6911:2006. More specifically, the surface resistivity of the printing paper is measured as described below. The test sample is pretreated by standing the test sample still in an environment at 23° C. and 50% RH for 12 hours. The electric power source and insulation resistance measuring device are used, and the pre-treated test sample is set so that the surface electrode is contacted with the coating layer side of the printing paper. Then, the test sample is charged with DC voltage of 100 V as a measurement electric power source for 30 seconds followed by the measurement 30 seconds after the completion of the charge, to calculate the surface resistivity, which are all conducted in the environment at 23° C. and 50% RH. Surface resistivity of the printing paper of the present invention is $2.0\times10^{10}$ Ω to $5.0\times10^{12}$ Ω, and preferably $4.0\times10^{10}$ Ω to $4.0\times10^{12}$ Ω. If the surface resistivity of the printing paper is outside the aforementioned range, color density uniformity and/or dot reproducibility cannot be obtained for the printing paper. Although the reason for this is unclear, it is presumed to be as described below. Since water-soluble pigment ink normally becomes charged due to stable dispersion during inkjet printing, the printing paper acts on the absorption of ink droplets during inkjet printing as a result of having a specific surface resistivity, and as a result thereof, color density uniformity and dot reproducibility are obtained. In the meanwhile, the surface resistivity, for which Ω/□ and Ω/sq are used as an normal unit, is also referred to as sheet resistance or merely to as surface resistance.

Surface resistivity can be adjusted by a method conventionally known in the field of papermaking. Examples thereof include a method consisting of adjusting the type and content of binder contained in the coating layer, a method consisting of adjusting the type and content of water-soluble polyvalent cation salt contained in the coating layer, a method consisting of adjusting the moisture content in the coating layer, and a method consisting of adjusting the coated amount. Moreover, surface resistivity can also be adjusted to a certain degree according to the base paper, and examples of such methods include a method consisting of adjusting the type and content of sizing agent internally added to the base paper and a method consisting of adjusting the moisture content of the base paper. Examples of sizing agents internally added to the base paper include rosin-based sizing agents in the case of acidic paper, and alkenyl succinic anhydrides, alkyl ketene dimers, neutral rosin-based sizing agents and cationic styrene-acrylic-based sizing agents in the case of neutral paper.

The printing paper can be subjected to calendering treatment after producing the base paper or after providing the coating layer. In the printing paper of the present invention, the aforementioned coating layer is the top layer.

The basis weight of the printing paper is preferably 40 $g/m^2$ or more. In addition, the basis weight when used as newsprint paper is preferably 55 $g/m^2$ or less. This is because, if basis weight is within the aforementioned ranges, the effect of inhibiting ink strike-through is demonstrated more prominently.

The printing paper of the present invention is used in an industrial rotary inkjet printing press. The industrial rotary inkjet printing press is preferably an industrial rotary inkjet printing press having a printing speed of greater than 100 m/min.

Method for Producing Printed Material

The method for producing a printed material according to the present invention comprises the steps of: obtaining the aforementioned printing paper and obtaining a printed material by printing on the printing paper with an industrial rotary inkjet printing press. According to the printed material production method of the present invention, printed material can be produced that demonstrates superior color density uniformity, superior strike-through inhibition and superior dot reproducibility in printed areas. The printing paper and industrial rotary inkjet printing press are the same as the aforementioned printing paper for an industrial rotary inkjet printing press and industrial rotary inkjet printing press, and duplicate explanations thereof are omitted.

The step of obtaining the aforementioned printing paper includes the production of printing paper and acquisition of the printing paper produced.

In the step of obtaining printed material by printing on the printing paper with an industrial rotary inkjet printing press, the industrial rotary inkjet printing press preferably uses a water-based pigment ink from the viewpoint of weather resistance of the resulting printed material.

In the step of obtaining printed material by printing on printing paper with an industrial rotary inkjet printing press, the printing speed is preferably greater than 100 m/min.

The printed material production method of the present invention may further comprise a step of printing on the aforementioned printing paper with a printing press selected from, for example, a gravure printing press, offset printing press, letterpress printing press or flexographic printing press before and/or after the step of printing with an industrial rotary inkjet printing press. As a result, fixed information and variable information can be accommodated in the printing step, and printed material can be obtained that has adequate image quality as a commercial product. Among the aforementioned printing presses, an offset printing press is preferable from the viewpoints of production cost and printing quality.

EXAMPLES

Although the following provides a more detailed explanation of the present invention through examples thereof, the present invention is not limited to the following examples provided the gist thereof is not exceeded. The terms "parts by weight" and "percent by weight" indicated in the examples indicate the values of dry solids or substantial components unless specifically indicated otherwise. In addition, coated amounts indicate values converted on the basis of the amount of dry solids.

<Measurement of Average Particle Diameter of Kaolin>

Average particle diameter of kaolin was calculated by capturing an electron micrograph of the coating layer surface of the printing paper with a scanning electron microscope (JSM-6490LA, JEOL Ltd.), calculating the particle diameter from the photographed image by assuming that the image area of the photographed kaolin particles approximates that of a sphere, and measuring the particle diameter of 100 kaolin particles present in the photographed image. The average particle diameters are described in Table 1.

Printing paper was fabricated for each of the examples and comparative examples according to the procedure indicated below.

<Preparation of Paper Stock>

Paper stock was prepared using the components indicated below.

| | |
|---|---|
| LBKP (freeness: 400 mlcsf) | 100 parts by weight |
| Sizing agent (alkyl ketene dimer) | Amount shown in Table 1 |
| Filler (precipitated calcium carbonate) | 20 parts by weight |
| Amphoteric starch | 0.08 parts by weight |
| Aluminum sulfate | 0.08 parts by weight |

<Preparation of Coating Layer-Coating Color>

Coating layer-coating colors were prepared using the components indicated below.

| | |
|---|---|
| Kaolin | Avg. particle diameter and incorporated amount shown in Table 1 |
| Other pigment | Type and incorporated amount shown in Table 1 |
| Phosphate starch | Incorporated amount shown in Table 1 |
| Ethylene-vinyl acetate copolymer | Incorporated amount shown in Table 1 |
| Water-soluble cation salt | Type and incorporated amount shown in Table 1 |

The aforementioned components were combined and then mixed and dispersed in water followed by adjusting to a concentration of 40% by weight.

<Fabrication of Printing Paper>

The aforementioned paper stock was made into paper with a Fourdrinier papermaking machine to obtain base paper. Continuing, the aforementioned coating layer-coating color was coated and dried on both sides of the base paper at a coated amount of 7 $g/m^2$ per side using a film transfer coater installed in an on-machine coater. After drying, calendering treatment was carried out to obtain printing paper having a basis weight of 49 $g/m^2$. Calendering was carried out using a device composed of an elastic roller and metal roller at a linear pressure of 50 kN/m over a range of nip linear pressure that allowed the obtaining of a suitable thickness profile in the direction of width. The temperature of the metal roller was made to be 40° C.

TABLE 1

| | Base paper | Coating layer | | | | | | | | | Printing paper surface |
|---|---|---|---|---|---|---|---|---|---|---|---|
| | | Pigment | | | | Binder | | | | | |
| | | Kaolin | | Other pigment | | | Ethylene-vinyl acetate copolymer | Water-soluble cation salt | | | |
| | Sizing agent (parts by weight) | Avg. particle diameter (μm) | (parts by weight) | Type | (parts by weight) | Phosphate starch (parts by weight) | (parts by weight) | Type | (parts by weight) | | resistivity (Ω) |
| Ex. 1 | 0.12 | 1.08 | 65 | A | 35 | 15 | 5 | a | 3.0 | | $5.0 \times 10^{11}$ |
| Ex. 2 | 0.12 | 1.08 | 65 | B | 35 | 15 | 5 | a | 3.0 | | $5.0 \times 10^{11}$ |
| Ex. 3 | 0.12 | 1.08 | 65 | C | 35 | 15 | 5 | a | 3.0 | | $6.0 \times 10^{11}$ |
| Ex. 4 | 0.12 | 0.24 | 65 | A | 35 | 15 | 5 | a | 3.0 | | $5.0 \times 10^{11}$ |
| Ex. 5 | 0.12 | 1.49 | 65 | A | 35 | 15 | 5 | a | 3.0 | | $5.0 \times 10^{11}$ |
| Ex. 6 | 0.12 | 1.08 | 50 | A | 50 | 15 | 5 | a | 3.0 | | $3.0 \times 10^{11}$ |
| Ex. 7 | 0.12 | 1.08 | 80 | A | 20 | 15 | 5 | a | 3.0 | | $8.0 \times 10^{11}$ |
| Ex. 8 | 0.12 | 1.08 | 65 | A | 35 | 15 | 5 | a | 1.1 | | $4.0 \times 10^{12}$ |
| Ex. 9 | 0.12 | 1.08 | 65 | A | 35 | 15 | 5 | a | 5.9 | | $2.1 \times 10^{10}$ |
| Ex. 10 | 0.12 | 1.08 | 65 | A | 35 | 15 | 5 | b | 3.0 | | $4.0 \times 10^{11}$ |
| Ex. 11 | 0.12 | 1.08 | 65 | A | 35 | 15 | 5 | c | 3.0 | | $4.5 \times 10^{11}$ |
| Ex. 12 | 0.03 | 1.08 | 65 | A | 35 | 15 | 5 | a | 3.0 | | $3.0 \times 10^{11}$ |
| Ex. 13 | 0.26 | 1.08 | 65 | A | 35 | 15 | 5 | a | 3.0 | | $1.0 \times 10^{11}$ |
| Ex. 14 | 0.12 | 1.08 | 65 | A | 35 | 5 | 20 | a | 3.0 | | $1.0 \times 10^{12}$ |
| Comp. Ex. 1 | 0.12 | 0.19 | 65 | A | 35 | 15 | 5 | a | 3.0 | | $5.0 \times 10^{11}$ |
| Comp. Ex. 2 | 0.12 | 1.60 | 65 | A | 35 | 15 | 5 | a | 3.0 | | $5.0 \times 10^{11}$ |
| Comp. Ex. 3 | 0.12 | 1.08 | 40 | A | 60 | 15 | 5 | a | 3.0 | | $2.5 \times 10^{11}$ |
| Comp. Ex. 4 | 0.12 | 1.08 | 65 | A | 35 | 15 | 5 | a | 0.8 | | $6.0 \times 10^{12}$ |
| Comp. Ex. 5 | 0.12 | 1.08 | 65 | A | 35 | 15 | 5 | a | 6.2 | | $1.0 \times 10^{10}$ |
| Comp. Ex. 6 | 0.12 | 1.08 | 65 | A | 35 | 15 | 5 | d | 3.0 | | $3.0 \times 10^{11}$ |
| Comp. Ex. 7 | 0.12 | 1.08 | 65 | A | 35 | 15 | 5 | — | — | | $1.0 \times 10^{13}$ |
| Comp. Ex. 8 | 0.12 | — | — | A | 100 | 15 | 5 | a | 3.0 | | $1.0 \times 10^{11}$ |
| Comp. Ex. 9 | 0.12 | 1.08 | 65 | A | 35 | 35 | 0 | a | 5.0 | | $1.5 \times 10^{10}$ |
| Comp. Ex. 10 | 0.12 | 1.08 | 65 | A | 35 | 0 | 35 | a | 1.5 | | $6.5 \times 10^{12}$ |

The other pigments shown abbreviated in Table 1 are as indicated below. A: Ground calcium carbonate (WH-90, Hyogo Clay Co., Ltd.) B: Precipitated calcium carbonate (TP123, Okutama Kogyo Co., Ltd.) C: Synthetic silica (NipGel AZ-204, Tosoh Silica Corp.)
Compounds selected from the water-soluble cation salts shown abbreviated in Table 1 are as indicated below. a: Calcium chloride b: Calcium nitrate c: Magnesium sulfate d: Sodium chloride The resulting printing paper of each of the examples and comparative examples was evaluated for each evaluation items according to the methods indicated below.

<Surface Resistivity>

Surface resistivity of the printing paper was measured basically in compliance with JIS K 6911:2006 at a charging voltage of 100 V and charging time of 30 seconds under environmental conditions consisting of 23° C. and 50% RH. More specifically, the test sample was pretreated by standing the test sample still in the environment at 23° C. and 50% RH for 12 hours. The electric power source and insulation resistance measuring device were used, and the pre-treated test sample was set so that the surface electrode is contacted with the coating layer side of the printing paper. Then, the test sample was charged with DC voltage of 100 V as a measurement electric power source for 30 seconds followed by the measurement 30 seconds after the completion of the charge, to calculate the surface resistivity, which were all conducted in the environment at 23° C. and 50% RH. Model 4329A High Resistance Meter and Model 16008A Resistivity Cell manufactured by Yokogawa Hewlett Packard Ltd. were used.

<Evaluation of Offset Printability>

Offset printability was evaluated by visually evaluating the occurrence of blanket piling and the status of printed samples by printing out 6000 m with an offset rotary printing press (Lithopia Model BT-2-600) manufactured by Mitsubishi Heavy Industries, Ltd. at a printing speed of 150 m/min using Web World TERAS black, indigo, red and yellow ink manufactured by DIC Corp. In the present invention, a rank of 3 to 5 indicates that the printing paper has offset printability.

5: Extremely good
4: Good
3: No problems in terms of practical use
2: Poor
1: Extremely poor <Evaluation of Color Density Uniformity>

An evaluation image was printed out for 6000 m at a printing speed of 105 m/min with water-based pigment ink using the JetLeader 1500 Inkjet Printing Press manufactured by Tokyo Kikai Seisakusho, Ltd. Solid patterns were printed out in a total of seven colors, consisting of each of the single colors of black, cyan, magenta and yellow along with dual colors (red, green and blue) using the three colors of ink excluding black, by a method consisting of recording the solid patterns measuring 3 cm×3 cm in a row horizontally without any gaps between. Color density uniformity of the solid image of each color was evaluated visually in the printed areas. In the present invention, a rank of 3 to 5 indicates that the printing paper has superior color density uniformity.

5: Uniform color density
4: Slightly non-uniform color density depending on color
3: Slightly non-uniform color density
2: Partially non-uniform color density
1: Non-uniform color density over entire printed area <Evaluation of Strike-Through Inhibition>

An evaluation image was printed out for 6000 m at a printing speed of 105 m/min using the JetLeader 1500 Inkjet Printing Press manufactured by Tokyo Kikai Seisakusho, Ltd. Black solid patterns were printed out by a method consisting of recording at a size of 10 cm×10 cm. Ink strike-through of the printing paper was evaluated by measuring brightness from the opposite side of the printed area using the brightness measuring method defined in JIS P 8148:2001, and calculating the value of "brightness of unprinted white area (optical %)"—"brightness of black solid printed area (optical %)". Brightness was measured using the PF-10 manufactured by Nippon Denshoku Industries Co., Ltd. under UV-blocking conditions by placing a single sample on a standard plate. In the present invention, a rank of 3 to 5 indicates that the printing paper demonstrates superior strike-through inhibition.

5: Less than 10 optical %

4: 10 optical % to less than 13 optical %

3: 13 optical % to less than 16 optical %

2: 16 optical % to less than 19 optical %

1: 19 optical % or more

<Evaluation of Dot Reproducibility>

An evaluation image using standard image data published by the Japan Standards Association (image name: N5A) was printed out for 6000 m at a printing speed of 105 m/min using the JetLeader 1500 Inkjet Printing Press manufactured by Tokyo Kikai Seisakusho, Ltd. The printed image was observed by microscope and dot reproducibility was evaluated visually based on the degree to which the shape of the impacted dots varied from a true circle and the distinctness of dot contours. In the present invention, a rank of 3 to 5 indicates that the printing paper demonstrates superior dot reproducibility.

5: Circular, distinct dots

4: Roughly circular, distinct dots

3: Slightly non-circular, slightly indistinct dots, but not to a degree that presents problems in terms of practical use 2: Somewhat non-circular, somewhat indistinct dots 1: Non-circular, indistinct dots Table 2 indicates the evaluation results of each of the examples and comparative examples.

TABLE 2

| | Offset printability | Color density uniformity | Strike-through inhibition | Dot reproducibility |
|---|---|---|---|---|
| Ex. 1 | 3 | 3 | 4 | 4 |
| Ex. 2 | 3 | 3 | 4 | 4 |
| Ex. 3 | 3 | 4 | 3 | 5 |
| Ex. 4 | 3 | 3 | 4 | 4 |
| Ex. 5 | 3 | 3 | 5 | 4 |
| Ex. 6 | 4 | 3 | 4 | 3 |
| Ex. 7 | 3 | 3 | 5 | 5 |
| Ex. 8 | 3 | 3 | 4 | 3 |
| Ex. 9 | 3 | 4 | 5 | 3 |
| Ex. 10 | 3 | 3 | 4 | 4 |
| Ex. 11 | 3 | 3 | 3 | 4 |
| Ex. 12 | 3 | 4 | 4 | 3 |

TABLE 2-continued

| | Offset printability | Color density uniformity | Strike-through inhibition | Dot reproducibility |
|---|---|---|---|---|
| Ex. 13 | 4 | 3 | 5 | 3 |
| Ex. 14 | 4 | 3 | 4 | 3 |
| Comp. Ex. 1 | 2 | 2 | 4 | 3 |
| Comp. Ex. 2 | 3 | 2 | 5 | 2 |
| Comp. Ex. 3 | 4 | 3 | 4 | 2 |
| Comp. Ex. 4 | 3 | 2 | 3 | 2 |
| Comp. Ex. 5 | 3 | 4 | 5 | 2 |
| Comp. Ex. 6 | 3 | 2 | 2 | 2 |
| Comp. Ex. 7 | 3 | 1 | 1 | 1 |
| Comp. Ex. 8 | 4 | 3 | 3 | 1 |
| Comp. Ex. 9 | 5 | 2 | 5 | 1 |
| Comp. Ex. 10 | 5 | 1 | 4 | 1 |

According to Table 2, the recording paper of each example corresponding to the present invention was determined to demonstrate superior offset printability, as well as superior color density uniformity, superior strike-through inhibition, and superior dot reproducibility with respect to an industrial rotary inkjet printing press using water-based pigment ink.

On the other hand, it was also determined from Table 2 that the effects of the present invention are unable to be obtained with each of the comparative examples that do not satisfy the conditions of the present invention.

What is claimed is:

1. Printing paper for an industrial rotary inkjet printing press, comprising a base paper and at least one coating layers containing pigment, binder and water-soluble polyvalent cation salt on at least one side of the base paper, wherein, at least one of the pigment is kaolin having an average particle diameter of 0.20 μm to 1.50 μm, and the content of the kaolin in the coating layer is 50 parts by weight or more based on 100 parts by weight of the pigment in the coating layer, the content of the water-soluble polyvalent cation salt in the coating layer is 1.0 parts by weight to 6.0 parts by weight based on 100 parts by weight of the pigment in the coating layer, and the surface resistivity on the coating layer side of the printing paper in an environment at 23° C. and 50% RH as determined basically in compliance with JIS K 6911:2006 is $2.0\times10^{10}$ Ω to $5.0\times10^{12}$ Ω.

2. A method for producing a printed material, comprising the steps of:

obtaining the printing paper for an industrial rotary inkjet printing press according to claim 1, and obtaining a printed material by printing on the printing paper with an industrial rotary inkjet printing press using water-based pigment ink.

* * * * *